United States Patent [19]

Otto et al.

[11] Patent Number: 4,813,853

[45] Date of Patent: Mar. 21, 1989

[54] INTERNAL GEAR PUMP

[75] Inventors: Dieter Otto, Ennepetal; Siegfried Hertell, Radevormwald, both of Fed. Rep. of Germany

[73] Assignee: Barmag AG, Remscheid, Fed. Rep. of Germany

[21] Appl. No.: 73,647

[22] Filed: Jul. 15, 1987

Related U.S. Application Data

[63] Continuation-in-part of Ser. No. 32,339, Jan. 9, 1987, Pat. No. 4,750,867.

[30] Foreign Application Priority Data

Jul. 19, 1986 [DE] Fed. Rep. of Germany ..... 3624517
Feb. 13, 1987 [DE] Fed. Rep. of Germany ..... 3704548

[51] Int. Cl.[4] ..... F04B 49/02
[52] U.S. Cl. ..... 417/295; 417/310
[58] Field of Search ..... 418/166, 171; 417/295, 417/310

[56] References Cited

U.S. PATENT DOCUMENTS

| | | | |
|---|---|---|---|
| 1,861,155 | 5/1932 | Douglas . | |
| 1,863,335 | 6/1932 | Hill . | |
| 2,428,181 | 9/1947 | Sibley | 418/166 |
| 2,916,999 | 12/1959 | Christenson et al. . | |
| 2,918,009 | 12/1959 | Crevoisier . | |
| 2,997,227 | 8/1961 | Ternent . | |
| 3,045,778 | 7/1962 | Mosbache | 418/171 |
| 3,424,095 | 1/1969 | Hanson | 418/61 B |
| 3,619,093 | 11/1971 | Harle | 417/310 |
| 3,898,025 | 8/1975 | Bottoms . | |
| 4,443,169 | 4/1984 | Merz | 418/171 |
| 4,480,962 | 11/1984 | Niemiec . | |
| 4,553,966 | 11/1985 | Boller . | |
| 4,642,033 | 2/1987 | Boller . | |
| 4,674,964 | 6/1987 | Hertell . | |

FOREIGN PATENT DOCUMENTS

| | | | |
|---|---|---|---|
| 173778 | 3/1986 | European Pat. Off. | 418/171 |
| 445893 | 6/1927 | Fed. Rep. of Germany . | |
| 409134 | 1/1924 | Fed. Rep. of Germany . | |
| 2421891 | 11/1975 | Fed. Rep. of Germany . | |
| 2425022 | 12/1975 | Fed. Rep. of Germany . | |
| 2622145 | 6/1977 | Fed. Rep. of Germany . | |
| 2705256 | 8/1978 | Fed. Rep. of Germany | 418/171 |
| 2758376 | 7/1979 | Fed. Rep. of Germany . | |
| 2815362 | 10/1979 | Fed. Rep. of Germany . | |
| 2933084 | 8/1981 | Fed. Rep. of Germany . | |
| 3210759 | 10/1983 | Fed. Rep. of Germany . | |
| 3444859 | 6/1985 | Fed. Rep. of Germany . | |
| 3506629 | 10/1985 | Fed. Rep. of Germany . | |
| 912425 | 8/1946 | France . | |
| 2228962 | 12/1974 | France . | |
| 2389783 | 12/1978 | France . | |
| 61-8484 | 1/1986 | Japan | 418/171 |
| 61-4882 | 1/1986 | Japan | 418/171 |
| 9359 | 6/1916 | United Kingdom . | |
| 265511 | 2/1927 | United Kingdom . | |
| 1491969 | 11/1977 | United Kingdom . | |
| 2049823 | 12/1980 | United Kingdom . | |
| 2069609 | 8/1981 | United Kingdom . | |
| 21041534 | 3/1983 | United Kingdom | 418/166 |

OTHER PUBLICATIONS

W. Beitz et al., "Dubbel, Taschenbuch fur den Maschinenbau", Edition 14, 1981, cover sheet and p. 453.
82 Olhydraulik und Pneumatik, vol. 23, No. 11, 1979, pp. 803–805.

*Primary Examiner*—William L. Freeh
*Attorney, Agent, or Firm*—Bell, Seltzer, Park & Gibson

[57] ABSTRACT

A hydraulic gear pump is disclosed wherein the meshing teeth of the gears define fluid cells which are expanded in the intake portion and receive the fluid from an inlet, and then compressed in the discharge portion to expel the fluid. The contact ratio of the cooperating driving flanks of the meshing teeth is smaller than the contact ratio of the cooperating sealing flanks of the meshing teeth, which serves to minimize the power requirement of the pump. The inlet to the pump includes at least two parallel lines which are each connected to a tank, and the first line is provided with a fixed throttle and the second line is provided with a pressure control valve which is controlled by the pressure in the pump discharge line.

11 Claims, 2 Drawing Sheets

INTERNAL GEAR PUMP

REFERENCE TO RELATED APPLICATIONS

This is a continuation-in-part of copending application Ser. No. 032,339, filed Jan. 9, 1987, now U.S. Pat. No. 4,750,867.

BACKGROUND OF THE INVENTION

The present invention relates to a hydraulic gear pump of the type which includes a toothed internal gear and a mating toothed external or pinion gear, and wherein the teeth define fluid cells which are alternately expanded and compressed upon rotation of the gears. In such pumps, the meshing teeth typically have a contact ratio equal to or greater than 2, with the contact ratio being defined as the average number of pairs of teeth in contact.

Hydraulic gear pumps of the described type are commonly employed as regulating pumps for hydraulic fluids. In such cases, the pump includes a plurality of fluid outlet openings which communicate with the fluid cells as they are compressed. The circular pitch of the outlet openings is smaller than or equal to the tooth pitch of the gears. Also, the outlet openings lead to a common discharge duct, or to groups of discharge ducts, and each outlet opening typically includes a non-return valve, although the outlet opening closest to the pitch point may not have a non-return valve.

The above described gear pumps are designed and constructed to have a delivery output characteristic which is speed dependent up to a limiting value, and wherein beyond the limiting value, the output remains substantially constant irrespective of the speed. The limiting speed can be adjusted by positioning an adjustable throttle in the fluid inlet line leading to the pump.

German OS No. 34 44 859 discloses a speed dependent gear pump wherein a contact ratio of at least 2 exists, so that the teeth of the pump form at least 2 and preferably 3 or more fluid cells which are sealed from each other on both the suction and the pressure sides.

In comparison with other known regulating pumps, wherein the delivery characteristic is not speed dependent, or in pumps where the delivery output is adjustable independently of the speed, the pump of the present invention has an advantage of being of sturdy construction, and which permits adjustment of the delivery output characteristic without expenditure for additional mechanical means. The pump of the present invention is particularly desirable for use as the regulating oil pump in an automobile engine, wherein the speed fluctuates constantly. In such uses, the pump serves as a hydraulic pump or the lubricating oil pump, since in these pumps the maximum discharge may be limited without loss in efficiency at a predetermined relatively low speed.

It is also an object of the present invention to provide an internal gear pump of the described type, and which is operable by a reduced power requirement as compared to conventional pumps of this type.

SUMMARY OF THE INVENTION

These and other objects and advantages of the present invention are achieved in the embodiment illustrated herein by the provision of a hydraulic pump which comprises a pump housing, a toothed internal gear rotatably mounted within the housing to define a central axis, and a toothed external or pinion gear mounted within the housing for rotation about an axis which is eccentric to the central axis. The teeth of the external gear mesh with the teeth of the internal gear and such that the interengaging teeth define fluid cells which are alternately expanded and compressed upon rotation of the gears. Also, the teeth of the gears define cooperating driving flanks and cooperating sealing flanks, with the sealing flanks having a contact ratio equal to or greater than 2, such that a plurality of fluid cells are formed in the area between the intersection of the addendum circles and the pitch point and which are sealed from each other. The driving flanks have a smaller contact ratio, which serves to reduce the power requirement of the pump.

The hydraulic pump of the present invention further includes fluid inlet means extending through the housing for delivering a fluid to each of the fluid cells while the fluid cells are in an expanded condition, and fluid outlet means is also provided which extends through the housing and communicates with the fluid cells during compression thereof and such that the fluid in such fluid cells is expelled through the fluid outlet means.

As indicated above, the tooth flanks of the present invention are so designed and constructed that the driving flanks have a smaller contact ratio than the sealing flanks. The contact ratio of a tooth system is generally defined as the ratio of the length of the line of contact of the teeth, to the pitch of the teeth. The length of the line of contact is defined as the distance between the initial and final points of contact which a selected tooth encounters during the start and end of intermeshing engagement with the respective tooth of the other gear. The contact ratio can also be viewed as approximately the average number of pairs of teeth in contact. Deviating from the engineering definition of the contact ratio, the contact ratio as used in the present application is understood to be the average number of pairs of teeth which engage each other respectively on either the driving flanks or the sealing flanks. In this regard, the driving flanks are in contact with each other and transmit the torque, and the sealing flanks face each other with such a small spacing of the flanks so as to effect a seal therebetween.

The invention is particularly advantageous in pumps operating in the low pressure area up to about 20 bar, and in particular in automobiles where it is important that a maximum discharge is obtained at relatively low speeds, while however the idling output and the mechanical power input may be kept low. A preferred application is the lubricating oil pump, which is positioned in the oil sump of the automobile engine.

In accordance with the present invention, the tooth flanks of the external pinion gear and/or the tooth flanks of the hollow internal gear are not symmetrical. In other words, the tooth flanks on the driving and the sealing sides are not mirror images of each other. It is important that the driving tooth flanks have only a relatively small area where contact occurs. This contact area, or zone of contact, is located, for both the pinion gear and the internal gear, between the pitch circle and the addendum circle, and starts at the respective pitch circle.

Outside of the above zone of contact, the tooth flanks resulting from a standard gear tooth cutting method may be reduced or deformed in such a way that no engagement of the teeth occurs. The presently proposed asymmetrical tooth form may also be obtained by a sintering method, wherein a correspondingly shaped tooth may be formed without a subsequent mechanical working operation.

Preferably, the zone of contact of the driving flanks is selected so that the contact ratio is between about 1 and 2 for the driving flanks. This relatively small contact ratio results in a considerable reduction of the mechanical power input, and in addition, it avoids an unacceptable wear, especially in hydraulic pumps operating in the low pressure range.

A substantial portion of the power required by the previously known internal gear pumps results from the fact that the fluid cells become very small in the area of the pitch point, and as a result, high fluid velocities there develop. In accordance with the present invention, this problem is alleviated, in that the roots of the teeth of the internal gear are radially separated a substantial distance from the addendum circle of the teeth of the external pinion gear, at the pitch point. This separation serves to widen the flow path and thus reduce the velocity of the fluid.

The reduction of the flow velocity, and the minimized power input as described above, may be employed in combination with other features in the present invention. Specifically, the entrances of the outlet openings are disposed between the line of contact of the meshing teeth and the external circumference of the internal gear, and preferably between the line of contact and the root circle of the internal gear, to thereby provide a narrow sealing web adjacent the line of contact. By this arrangement, the cross sectional area of the entrances of the outlet openings may be aligned with the spaces between the teeth of the internal gear and so as to be somewhat smaller than the cross sectional area of the teeth of the internal gear. As a result, the outlet entrances mating with a fluid cell are covered by the tooth cross section of the internal gear, and consequently, always separated from each other, so that no short circuit can occur between the fluid cells via the outlet entrances. On the other hand, the entrances of the outlet openings open to the fluid cells over a large area.

In order to further enhance the area of communication between the fluid cells and outlet openings, the entrances of the outlet openings extend beyond the root circle of the internal gear, and the root of the teeth of the internal gear include an inclined surface which extends radially outwardly from the remainder of the root, and so as to enlarge the passage from the fluid cells into the entrances of the outlet openings. This results in a further reduction of the fluid velocity and throttling losses.

BRIEF DESCRIPTION OF THE DRAWINGS

Some of the objects and advantages having been stated, others will appear as the description proceeds, when considered in conjunction with the accompanying drawings, in which.

DETAILED DESCRIPTION OF THE PREFERRED EMBODIMENT

Figure 1:
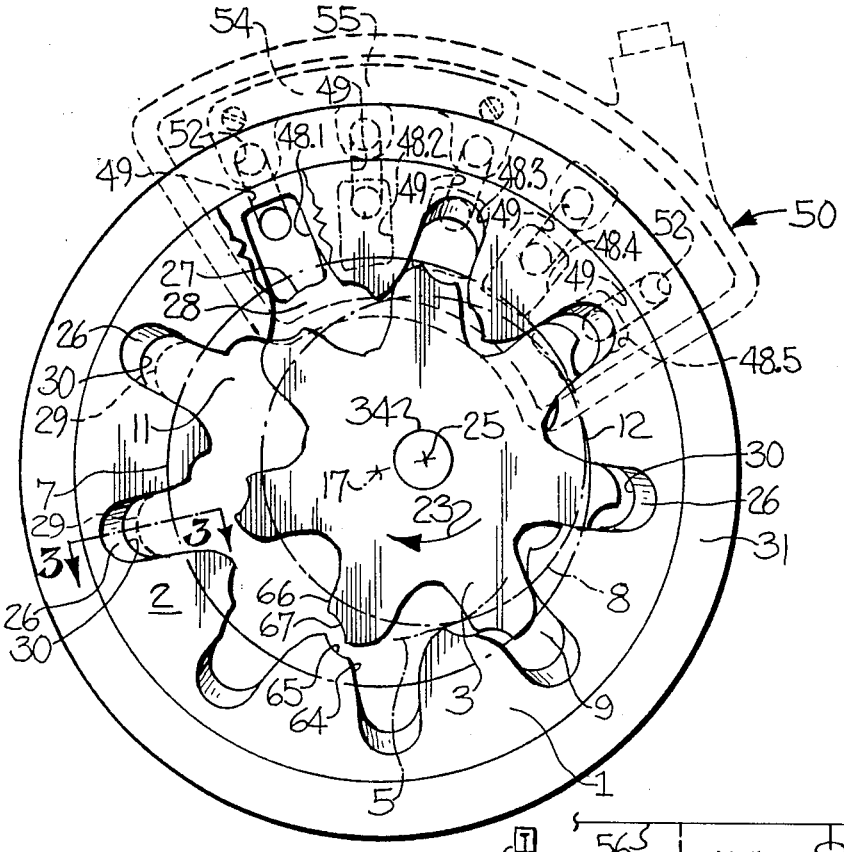
FIG. 1 is a sectional front view of a hydraulic gear pump embodying the features of the present invention, and which illustrates the outlet entrances on both sides of the pump housing.

Referring more particularly to the drawings, a hydraulic pump is illustrated which comprises a pump housing 31, which is closed on its front and rear sides by covers 33 and 32 respectively. A shaft 34 is rotatably supported in the cover 32 and is driven by a suitable motor (not shown).

A toothed internal gear 1 is rotatably mounted within the housing 31 to define a central axis 17, a pitch circle 7, and an addendum circle 5. Also, a toothed external or pinion gear 3 is fixedly mounted on the shaft 34, and so that the gear 3 rotates about the axis 25 of the shaft 34 which is eccentric to the central axis 17 defined by the gear 1. The external gear 3 has teeth 4 which mesh with the internal teeth 2 of the internal gear 1. The external gear teeth 4 define a pitch circle 8, and an addendum circle 9, and the pitch circles 7 and 9 define a pitch point 12. The interior of the pump housing also includes a crescent shaped cavity which substantially conforms to the addendum circles of the gear teeth.

The meshing teeth of the gears 1, 3 define fluid cells which are alternately expanded and compressed during rotation of the gears. Also, a fluid inlet means is provided for delivering a fluid such as oil to each of the fluid cells while the cells are in an expanded condition. This fluid inlet means comprises an inlet port 35 in the cover 33 of the pump housing, a fluid supply tank 36, and a first fluid line 68 extending from the tank 36 to the port 35. A fixed throttle 37 is mounted in the line 28.

Figure 2:
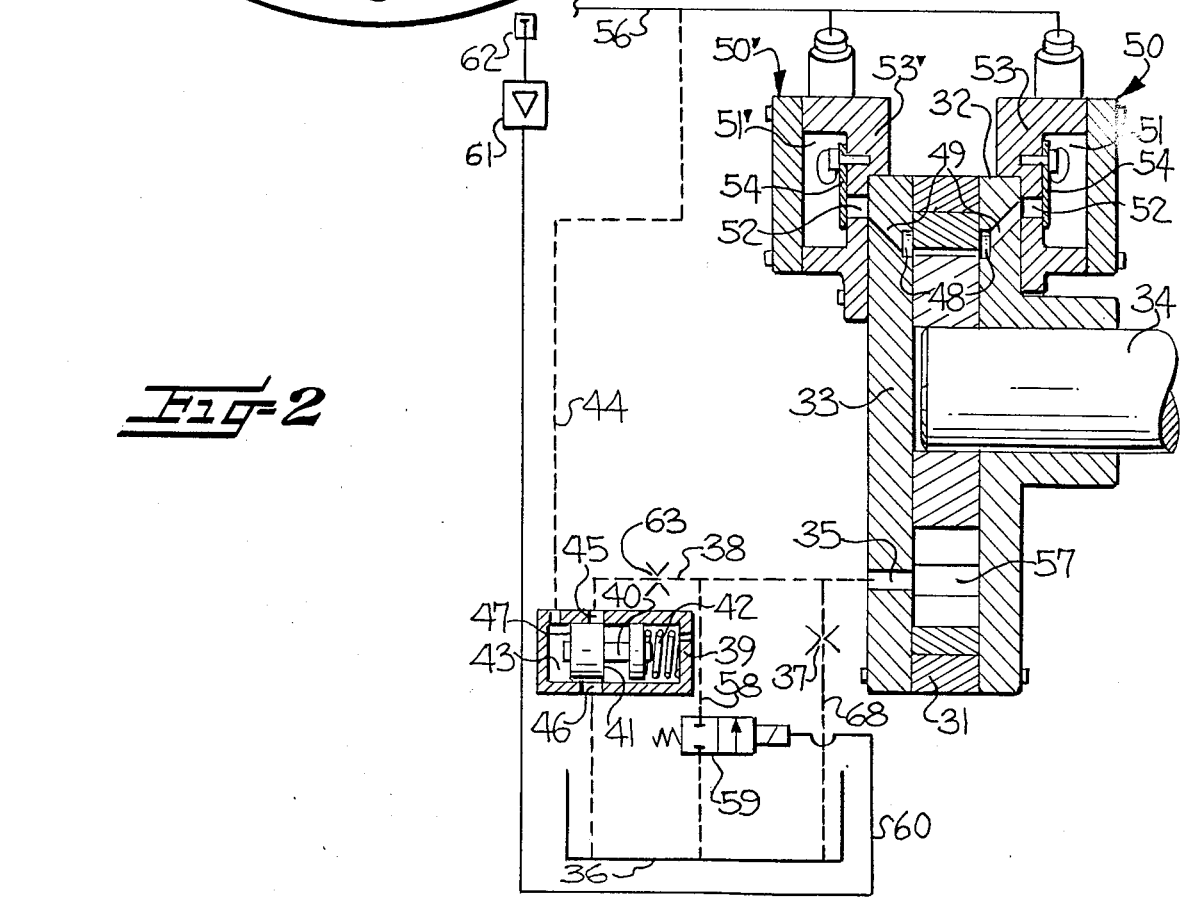
FIG. 2 is a sectional side elevation view of the pump shown in FIG. 1, together with a schematic illustration of the control means for the fluid inlet line.

The fluid inlet means also includes a second fluid line 38 which is parallel to the first line 28, and with the second line 38 including a pressure control valve 39 therein. The valve 39 includes a piston 40 which is axially movable in a supporting cylinder so as to control the passage of the fluid from the tank 36 and through the inlet 46 and outlet 45 in the cylinder, and which is connected in the line 38. For this purpose, the piston includes a control edge 41 which cooperates with the inlet 46 and outlet 45, and the piston is biased by a spring 42 toward the left as seen in FIG. 2 and so as to open passage through the inlet and outlet. The opposite edge 47 of the piston is biased by the pressure in a control chamber 43, and which is connected via a control line 44 to the output pressure of the pump as further described below. As long as there is little or no discharge pressure in the control line 44 and in the control chamber 43, the piston releases the passage from the inlet 46 to the outlet 45, and fluid can then flow from tank 36 to the pump via both the first line 28 and the throttle 37, and through the second by-passing line 38. When the pressure in the control chamber 43 increases and overcomes the force of the spring 42, the inlet 46 is closed relative to the outlet 45. At this point, only a throttled oil stream continues to flow from the tank 36 through the first line and throttle 37, and to the inlet port 35 of the pump. If the outlet pressure continues to increase, the pressure control valve 39 will operate as a pressure relief valve. More particularly, the spring 42 is compressed to an extent such that the front control edge 47 of the piston opens the pressure line 44 to the inlet 46 and to the tank 36.

The fluid inlet port 35 is positioned so as to deliver the fluid to the fluid cells while they are in an expanded condition. Also, fluid outlet means communicates with these fluid cells during compression thereof and such that the fluid in the cells is expelled through the fluid outlet means. More particularly, the meshing teeth form three fluid cells which are closed in the circumferential and the axial directions, and which may be completely or partially filled with oil via the inlet port 35. The fluid outlet means includes three outlet entrances 48.1, 48.3, and 48.5 formed on the inside surface of the cover 33, and two outlet entrances 48.2 and 48.4 on the inside surface of the cover 32. The outlet entrances of the cover 33 are displaced relative to the outlet entrances of the cover 32 by one-half the pitch of gear teeth as seen in FIG. 1, and when projected on a normal plane, the outlet entrances in the covers 32 and 33 do not overlie each other. The outlet entrances also include a radial inner edge 27 which closely follows the contour of the contact line 11 of the meshing teeth, in such a manner that only a narrow, but adequate sealing web 28 remains between the line of contact 11 and the inner edge 27. The circumferential width of the outlet entrances 48.1–48.5 is selected so that the outlet entrances are covered by the cross section of the teeth 2 of the internal gear 1, and in the overlying position, there remains an adequate sealing surface in the circumferential direction. In the radial direction, the outlet entrances extend immediately adjacent the outer circumference of the internal gear 1, and in any event, they extend to the outermost area at which the roots of the teeth of the gear 1 terminate.

Figure 3:
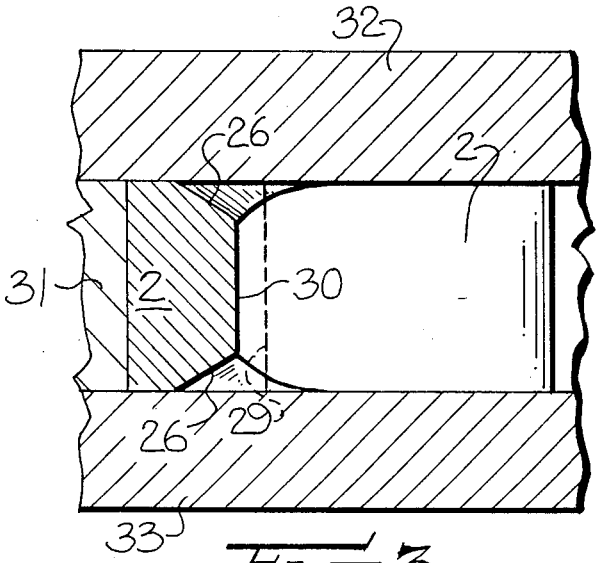
FIG. 3 is a fragmentary sectional view of one of the teeth of the internal gear, and taken substantially along the line 3—3 of FIG. 1.

Referring more particularly to the configuration of the root of the teeth 2 of the gear 1, reference is made to FIGS. 1 and 3. Specifically, the teeth of the internal gear 1 may be made according to a standard law governing a gear tooth system, and an ideal root resulting from such a law is illustrated in dashed lines at 29. However, in the preferred embodiment of the present invention, the root is radially extended, and so as to form the root at 30. In the specific illustrated embodiment, the root 30 represents half the outer surface of a circular cylinder, the axis of which is located on the axis of symmetry of the tooth space and substantially on the pitch circle 7 of the internal gear 1. In addition, both side edges of the roots 30 of the teeth include a funnel-shaped inclined surface 26. The surfaces 26 extend radially almost to the outer circumference of the internal gear 1, however, they may also extend in the circumferential direction. In any event, the surfaces 26 are located radially outside of the pitch circle 7 of the gear 1. In the event the pump of the present invention is designed to discharge the oil only toward one side, the funnel-shaped surfaces will be located only on the respective side edge of the root. Also, the outlet entrances 48.1–48.5 in any event extend radially outwardly to an extent sufficient to cover the funnel-shaped surfaces 26.

FIG. 2 illustrates one of the outlet entrances in each cover 32, 33, and which is indicated generally by the numeral 48. Each of these outlet entrances is connected with an outlet passage 49 which extends through the associated cover in a radially inclined direction. As a result, each outlet passage 49 terminates on the outside of the associated cover as closely as possible to the housing 31.

A discharge housing 50 is mounted on the cover 32 in a pressure tight arrangement, and a similar discharge housing 50' is mounted on the cover 33. The discharge housings define an internal discharge chamber 51, 51' respectively, and each of the housings includes an inner wall 53, 53' which includes a bore 52 communicating with each of the passages 49. Thus the chamber 51' is connected via the passages 49 and bores 52 with the outlet entrances 48.1, 48.3, and 48.5. The chamber 51 is similarly connected via the associated passages 49 and bores 52 with the outlet entrances 48.2 and 48.4. As best seen in FIG. 1, the bores 52 are each closed by a non-return valve 54, except for the bore 52 which is associated with the outlet entrance 48.5. The outlet entrance 48.5 is located at the end of the pressure zone directly adjacent the pitch point 12. Also, the discharge chambers 51, 51' are connected with a common outlet duct 56.

The non-return valves 54 are in each case in the form of an U-shaped metal sheet, which is secured to the wall 53 of the housing by a bolt. The valves thus define a lateral traverse 55 and two projecting tongues which project from the common traverse 55 and which cover the associated bores 52. As a result, these tongues function as non-return valves. Each non-return valve releases the connection to the respective fluid cell, which is formed between the teeth, via one of the outlet entrances 48, passages 49, and bores 52, only when the pressure of the fluid cell is at least equal to the discharge pressure in the chamber 51 or 51'. The final and smallest fluid cell is connected via the entrance 48.5 and corresponding ducts 49, 52, directly with the discharge chamber.

Figure 4:
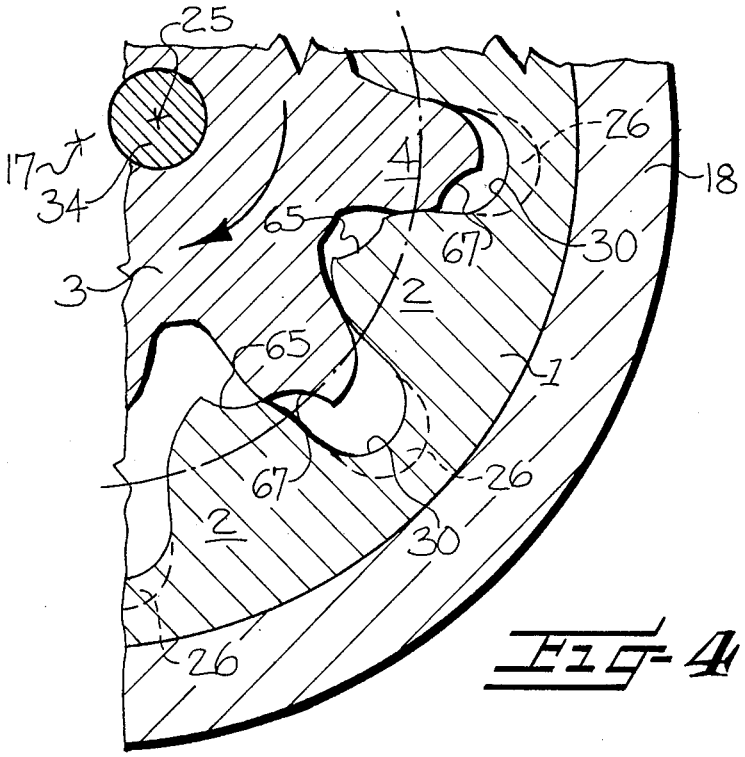
FIG. 4 is a fragmentary view of a portion of the intermeshing teeth as shown in FIG. 1, and illustrating the teeth in cross-section.

Referring again to FIG. 1 and 4 it will be seen that the teeth 2 of the internal gear 1 are asymmetrically constructed. More particularly, both flanks of each tooth 2 may be initially formed according to a conventional law governing a standard gear tooth system. This law ensures that a high contact ratio exists, which is greater than 2, and preferably greater than 3. As a result, the teeth in substantially the entire zone of rotation between the intersection of the two addendum circles 5 and 9, and the pitch point 12, are engaged, and more than two fluid cells are formed by two successive pairs of teeth. These fluid cells are sealed against each other in the circumferential direction. This law of a gear tooth system also provides that the driving flanks of the internal gear 3 and the external gear 1 have a correspondingly large contact ratio. In accordance with the present invention however, on the driving side of the teeth, the contact ratio is smaller than on the sealing side of the teeth. This means that the tooth flanks which are sealably superposed in the pressure zone between the intersection of the addendum circles and the pitch point form fluid cells which are sealed against each other, and are made in accordance with the standard law of the gear tooth system. These tooth flanks are described herein as the sealing flanks.

The flanks of the teeth of the gear 1 and 3, and which serve to transmit the torque between the gears, are made with a smaller contact ratio, which preferably ranges between 1 and 2. This is achieved by constructing the flanks so that only a portion of the driving flanks are fabricated in accordance with the standard law of the tooth system, and this portion defines a zone of contact 64 on the driving flanks and which extends from the pitch circle 7 of the gear 1 radially inwardly over a short distance. At 65 is indicated the cross sectional range by which the driving flank of the gear 1 deviates from the standard profile.

The zone of contact 66 of the driving flanks of the gear 3 extends from the pitch circle 8 radially outwardly over a short distance. At 67 is indicated the cross sectional range of the tooth crown by which the driving tooth flanks of the internal gear 3 recede with respect to the standard tooth profile.

As indicated above, either the driving flanks of the gear 1 or the driving flanks of the external gear 3, or both, may be provided with the recesses 65 or 67 as described above. Providing recesses on both such flanks has the advantage that relatively small flow velocities develop on the suction side of the pump. The zone of contact of the driving flanks of the internal gear and/or the external gear which is formed in accordance with the standard tooth profile, is so dimensioned that at least one pair of teeth of the gears is always engaged, but that on the other hand a smaller number of pairs of teeth are engaged on the driving side than on the sealing side. Preferably, the contact ratio on the contact side is not greater than 2, as a result of the correspondingly short length of the zones of contact.

To now describe the operation of the pump, when a low pressure is present in the discharge chambers 51, 51' the spring 42 moves the piston 40 to the left as seen in FIG. 2. The pump then operates as a normal internal gear pump, and the oil flows through the first line 68 and throttle 37, and through the parallel second line 38, to the inlet port 35. The fluid cells in the area of the inlet port 35 are filled to their maximum, and the fluid is expelled when the cells move through the discharge side of the pump. Whether the filling is complete or only partial depends on the resistance of the throttle 37 and the by-pass duct 38. Schematically illustrated in FIG. 2 is a throttle 63, which indicates that the by-pass 38 also has a throttling effect, which may result in the fact that the fluid cells are only partially filled at high speeds, as further explained below.

When the pressure in the discharge chambers 51, 51' increases as the speed increases, the by-pass line 38 is initially closed by the valve 39. At this point, only a heavily throttled fluid stream reaches the intake side of the pump, and as a result, the fluid cells on the intake side are only partially filled. Also, a partial vacuum is present in the fluid cells, which results in the fact that the pressure in the cells on the discharge side of the pump is initially lower than the pressure in the discharge chambers 51, 51'. Consequently, the tongues of the non-return valve 54 remain closed. However, as the cells become progressively smaller on the discharge side, the pressure increases in the cells, and those tongues of the non-return valve open where the pressure in the cell is higher than or equal to the pressure in the discharge chambers 51, 51'. As a result, the pump continues to deliver a speed independent, constant quantity of fluid, and it is not necessary, even as the speed increases, to divert an excessive quantity of the fluid to a sump so as to incur corresponding losses of efficiency as is the case with conventional systems. The pump is therefore particularly suitable for use in supplying lubricating oil to an internal combustion engine of an automobile. If, in such a case, the requirement for lubricating oil increases, resulting for example from wear, the threshold pressure in the pressure chambers 51, 51' will be reached only at a higher speed. Consequently, the by-pass line 38 closes at a later time, and as a result thereof, the pump adapts itself automatically to an increased demand. Thus the lubricating oil pump will also satisfy an increasing need for lubricating oil during the entire service life of the engine. At the same time, the pump will operate economically also in a new motor which requires relatively little lubricating oil, since a portion of the output which is not needed, is prevented from having to be diverted, with energy loss, to a sump.

The pump of the present invention also meets the additional requirements of special operating conditions. Thus, for example, the lubricating oil may heat excessively in a motor vehicle engine, or the engine parts may require cooling by the oil by reason of special operating conditions. In these instances, and as shown in FIG. 2, an additional by-pass or third fluid line 58 is provided between the inlet port 35 of the pump and the tank 36. Also, an electromagnetically operated valve 59 is positioned in this line 58. The valve 59 is actuated, for example, by a temperature sensor 62, which sends a signal through the amplifier 61 and line 60 to the valve 59. The temperature sensor permits the detection of the oil temperature, or the temperature of a machine part, such as a piston. In a like manner, it is possible to use another measuring instrument, such as a tachometer, rather than a temperature sensor 62, for detecting other extraordinary operating conditions. In any case, the valve 59 serves the purpose of satisfying the extraordinary demand. It will be understood that the sum of the oil delivered through the first line 68 and throttle 37, and through the by-pass line 38, is still throttled to some degree, and as a result, the cells of the internal gear tooth system may be only partially filled despite the opened control pressure valve 39, when speeds above a predetermined threshold speed are reached. The line 58 and valve 59 are thus able to provide a further output under these conditions.

To meet an extraordinary demand, it is also possible to adjust the spring side 42 of the pressure control valve 39 by means of a suitable valve (not shown), from a low pressure at which a relatively low discharge pressure is adjusted on the discharge side of the pump via line 44, to a higher pressure, under which the discharge pressure is correspondingly increased.

As noted above, the effectiveness of the pump of the present invention is dependent on the configuration of the gear teeth, and so that the teeth mesh in the discharge area between the intersections of the addendum circles and form closed cells, when the viscosity of the oil is considered. Also, the described design avoids unnecessarily great losses of efficiency resulting from the filling and expelling of the fluid from the cells. This is accomplished, on the one hand, by the fact that the contact ratio is smaller on the driving side of the teeth than on the sealing side of the teeth. In this case, a judgment must be made between the prevention of mechanical losses of efficiency on the one hand, and an increased wear on the other hand. This judgment depends on the purpose of the pump. In the case of high pressure hydraulic pumps, losses of efficiency play a relatively minor roll. On the other hand, a substantial surface pressure exists between the pairs of teeth, resulting in a correspondingly high degree of wear. Consequently, a relatively high contact ratio should be selected on the driving side of the teeth in the case of high pressure pumps. In the case of pumps designed for operation in the low pressure range, such as for example, lubricating oil pumps in automobiles, or hydraulic pumps for servo-steering and other consumers, it will be possible to operate without increased wear with a contact ratio on the driving side of the teeth which ranges between 1 and 2, since due to the low pressure, a wear increasing surface pressure is not present.

The radial extension of the root 30 of the teeth 2 permits a greatly reduced flow velocity as the fluid is expelled from the fluid cells, in particular in the area immediately adjacent the pitch point 12. Basically, the root 30 of the internal gear 1 may be extended radially outside the pitch circle 7 as far as to reach the limit of rigidity of the gear. In one embodiment the maximum discharge flow velocity was decreased from 20 m/second to 5 m/second. This reduction of the flow velocity simultaneously meant an increase in the hydraulic efficiency. The same purpose is served by the funnel-shaped surfaces 26 on the edges of the roots 30, and the corresponding dimensioning of the outlet entrances 48.1–48.5.

The fact that the outlet entrances 48.1–48.5 are arranged radially outside of the line of contact 11, while maintaining a narrow but adequate sealing web 28, ensures that no short circuit occurs between successive fluid cells, via the outlet entrances. This makes it possible to arrange the outlet entrances over a very large surface area. The area of the outlet entrances is selected so that it is covered by the tooth cross section of the gear 1, with adequately wide sealing surfaces in the circumferential direction. In this regard however, the outlet entrances may also be selected to extend over a very large surface area, and furthermore, the entrances may be arranged at a smaller pitch than the tooth pitch. This will ensure that a large surface area cross section exists between the fluid cells and the outlet entrances.

In the drawings and specification, a preferred embodiment of the invention has been illustrated and described, and although specific terms are employed, they are used in a generic and descriptive sense and not for purposes of limitation.

We claim:

1. A hydraulic pump comprising pump housing, a toothed internal gear rotatably mounted within said housing to define a central axis, a toothed external gear mounted within said internal gear in said housing for rotation about an axis which is eccentric to said central axis, and with the teeth of said external gear meshing with the teeth of said internal gear and such that the interengaging teeth define fluid cells which are alternately expanded and compressed upon rotation of said gears, and so as to define a suction side of the pump where the cells are being expanded and a compression side of the pump where the cells are being compressed, means for rotatably driving said external gear, said teeth of said gears defining cooperating driving flanks which transmit the rotational torque and which seal the fluid cells on the suction side, and cooperating sealing flanks which seal the fluid cells on the compression side, and with the driving flanks and the sealing flanks each defining a contact ratio which is the ratio of the length of the line of contact of the flanks during their intermeshing engagement to the pitch of the teeth, and with the sealing flanks having a contact ratio equal to or greater than 2 and with said driving flanks having a smaller contact ratio which is between about 1 and 2, and such that there are fewer closed cells on the suction side than on the compression side, fluid inlet means extending through said housing for delivering a fluid to each of said fluid cells while the fluid cells are in an expanded condition, and fluid outlet means extending through said housing and communicating with said fluid cells during compression thereof and such that the fluid in such fluid cells is expelled through said fluid outlet means.

2. The hydraulic pump as defined in claim 1 wherein the contact ratio of said sealing flanks is equal to or greater than 3.

3. The hydraulic pump as defined in claim 2 wherein the roots of the teeth of said internal gear are radially separated a substantial distance from the addendum circle of the teeth of said external gear at the pitch point.

4. The hydraulic pump as defined in claim 2 wherein said fluid outlet means includes a plurality of separate outlets extending through said housing and positioned along the rotational direction of said fluid cells, and with said outlets each having an entrance which is aligned with the spaces between the teeth of the internal gear and which is somewhat smaller in area than the cross sectional area of the teeth of said internal gear.

5. The hydraulic pump as defined in claim 4 wherein at least the upstream ones of said outlets include one way valve means mounted therein to permit flow only outwardly from said housing.

6. The hydraulic pump as defined in claim 4 wherein said entrances of said outlet openings are positioned closely adjacent but spaced from the line of contact defined by the meshing teeth.

7. The hydraulic pump as defined in claim 6 wherein at least one of the side edges of each root of the teeth of the internal gear include an inclined surface which extends radially outwardly from the remainder of the root and so as to enlarge the passage from the fluid cells into said entrances of said outlet openings.

8. The hydraulic pump as defined in claim 1 wherein said fluid inlet means includes a first fluid line having a throttle therein for limiting the fluid flow rate therethrough, and a second fluid line which is parallel to said first line, with said second line including a pressure controlled valve therein, and control means operatively interconnecting said pressure control valve and said fluid outlet means and for opening the pressure control valve when the pressure in said fluid outlet means is below a predetermined value and closing said pressure control valve when the pressure in said fluid outlet means is above a predetermined value.

9. The hydraulic pump as defined in claim 8 wherein said fluid inlet means further comprises a fluid tank, with each of said first and second fluid lines communicating with said tank.

10. The hydraulic pump as defined in claim 9 wherein said fluid inlet means further includes a third fluid line positioned in parallel with said first and second fluid lines and communicating with said tank, with said third fluid line being unthrottled and including a selectively actuated valve therein, and means for selectively actuating said valve in response to an externally monitored parameter.

11. The hydraulic pump as defined in claim 8 wherein said pressure controlled valve includes means for opening said fluid outlet means to said tank when a predetermined pressure is present in said fluid outlet means.

* * * * *